United States Patent [19]

McCloskey et al.

[11] Patent Number: 4,737,321

[45] Date of Patent: Apr. 12, 1988

[54] AIR DISTRIBUTION SYSTEM FOR LARGE COOLING TOWERS

[75] Inventors: William D. McCloskey, Catonsville; John R. Huffaker; Nelson T. Smith, both of Ellicott City, all of Md.

[73] Assignee: Baltimore Aircoil Company, Inc., Jessup, Md.

[21] Appl. No.: 2,572

[22] Filed: Jan. 12, 1987

[51] Int. Cl.[4] ..... B01F 3/04

[52] U.S. Cl. ..... 261/109; 261/DIG. 11

[58] Field of Search ..... 261/109, DIG. 11

[56] References Cited

U.S. PATENT DOCUMENTS

| | | | |
|---|---|---|---|
| 2,394,755 | 2/1946 | De Flon | 261/109 |
| 3,400,917 | 9/1968 | Richards | 261/109 |
| 3,846,519 | 11/1974 | Spangemacher | 261/109 |
| 4,094,937 | 6/1978 | Bodick et al. | 261/109 |
| 4,164,256 | 8/1979 | Kelp | 261/109 |
| 4,374,071 | 2/1983 | Regehr | 261/109 |

FOREIGN PATENT DOCUMENTS

| | | | |
|---|---|---|---|
| 759046 | 11/1969 | Belgium | 261/DIG. 11 |
| 2416126 | 1/1975 | Fed. Rep. of Germany | 261/DIG. 11 |
| 562547 | 11/1923 | France | 261/DIG. 11 |
| 263114 | 8/1927 | United Kingdom | 261/DIG. 11 |
| 571510 | 8/1945 | United Kingdom | 261/DIG. 11 |
| 560115 | 5/1977 | U.S.S.R. | 261/DIG. 11 |

*Primary Examiner*—Tim Miles

*Attorney, Agent, or Firm*—Charles E. Bouton; Edward J. Brosius

[57] ABSTRACT

Airflow to the interior portions of large counterflow cooling towers is improved by the provision of passageways from about the perimeter of the tower which passageways are free of fill and descending water so as to not obstruct inward movement of air from the perimeter, and which passageways also segregate fill against the possible spread of combustion.

11 Claims, 5 Drawing Sheets

AIR DISTRIBUTION SYSTEM FOR LARGE COOLING TOWERS

BACKGROUND OF THE INVENTION

This invention relates to large cooling towers and more specifically to improved air distribution within a large counter-flow cooling tower.

Cooling towers function to exchange heat from water to air and usually are denominated as parallel flow, cross flow or counter-flow according to the relative flow of air and water. The heat exchange may occur by simply passing air past a stream of water. However since the exchange takes place at the water surface it is advantageous to maximize the water surface per unit volume of water. Normally this is done by breaking the water flow into small droplets or spreading the water flow across multiple sheets of fill material, and in the latter instance the air is moved between the fill sheets. The usual cooling tower thus contains banks of closely spaced fill sheets arranged vertically with an overhead warm water distribution network and a cooled water collection pool beneath the fill sheets. Air is moved between the sheets to thereby cool the downwardly flowing water by both conduction and evaporation. The air will be drawn from outside the tower, moved upwardly in a counter-flow cooling tower, and its cooling capacity will be used and reduced as it moves past the water surface toward the warm water source.

It is notable that the fill sheet material is often manufactured of a flammable material and it is possible, particularly during periods that water flow may be terminated, diverted or diminished, for combustion to occur within the fill of a cooling tower. Thus it would be advantageous to devise means to limit the opportunity for combustion to initiate and/or to spread within the fill in a cooling tower.

Cooling towers are constructed in an extremely wide range of sizes extending from small commercial units only a few feet high and wide to enormous industrial units measuring in the hundreds of feet. For example hyperbolic cooling towers measuring 400 feet in diameter, at the base, and 500 feet high have been constructed for the nuclear power industry to induce upward air drafts sufficient to cool water at rates in excess of a half million gallons per minute. Nevertheless those enormous units and the small units function in essentially the above described manner.

In counter-flow cooling towers the ambient air is shielded from the sides of the fill and is permitted entrance from only the underside so that it crosses the full vertical dimension of the fill sheets. The physical structure of most counter-flow cooling towers usually requires that the unit rest upon the earth or some building so as to require ambient air to enter horizontally at the bottom of the unit beneath the fill sheets, usually from about the perimeter or circumference thereof, and turn upwardly within the tower unit. It has been found that as a result relatively larger quantities of the upwardly moving air will become concentrated at the outer portions of the fill sheets while the interior portions will become relatively starved for air and the heat exchange becomes inefficient in the center of the unit. It follows that as the horizontal dimensions of a counterflow cooling tower become larger there will be an ever greater portion and quantity of internally located fill sheet surface that will be relatively starved for air and thus a substantial loss of real cooling capacity will occur.

Moreover the usual cooling tower structure includes a sump-pan, pool or reservoir at the bottom to receive the cooled water that falls from the bottom of the fill sheets. The ambient air flow must enter horizontally between the sump and the bottom of the fill sheets through a space that is filled with free falling droplets and streams of water which not only physically impede horizontal air movement but also begin to warm and saturate the air before it reaches the centrally located fill sheets. Thus it has been found that as the distance increases through which an increment of ambient air must move horizontally through free falling water the increment of air encounters increasing flow resistance and suffers a loss in its capacity to absorb additional heat; and the air that heretofore has reached the internal portion of large dimension cooling towers has been reduced in velocity and quantity and has had significantly diminished cooling capacity. Thus it would be advantageous to devise a means to introduce fresh ambient air to the internal portions of a cooling tower without having to pass first through an area of freely falling water.

Our recognition of the significance of these factors tending to reduce the effectiveness of the internal portions of large cooling towers, especially the enormous hyperbolic towers, has enabled us to devise structural features that overcome the problems and deliver fresh ambient air to the internal portions of the fill. The same structural features also serve to segregate adjacent areas of fill against spread of combustion.

SUMMARY OF THE INVENTION

Thus it is a principal object of the present invention to provide structure within a cooling tower to deliver ambient air to the internal portions thereof.

It is another object of the present invention to provide structure within a large cooling tower to relatively evenly deliver ambient air across the entire horizontal area of fill exposure.

It is yet another object of the present invention to provide a large cooling tower with air flow means to convey quantities of ambient air horizontally to the internal area of the tower and restrain vertical movement of such air quantities while moving horizontally.

It is still another object of the present invention to provide means within a large cooling tower to segregate multiple areas of fill so as to hinder the spread of combustion between such areas.

Briefly summarized the invention involves the provision of passageways extending from substantially the outer perimeter of the tower to the center thereof and excluding the fill and falling water from within and beneath the passageways so as to enable air to move unobstructed to the center of the tower beneath the fill. Preferably the passageways are covered and enclosed by walls at two sides so as to prevent the ambient air from entering the sides of the fill and also to isolate and segregate sections of fill so as to contain damaging conditions such as fire and the like.

DESCRIPTION OF THE DRAWINGS

Further objects and advantages will become apparent from the following detailed description of the invention when read in conjunction with the drawings wherein.

DETAILED DESCRIPTION OF THE INVENTION

Figure 1:
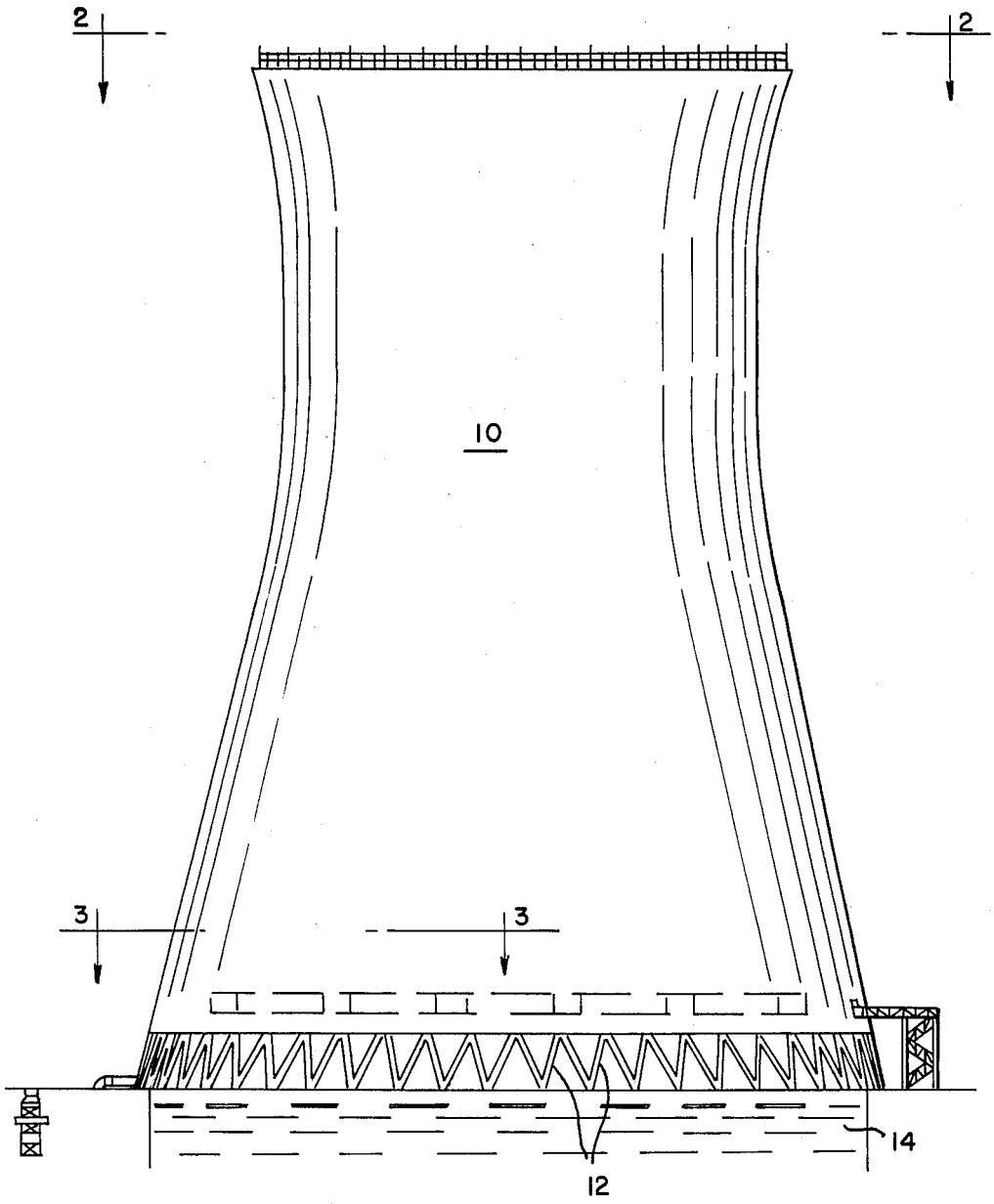
FIG. 1 is a side elevation of a typical large hyperbolic counterflow cooling tower.

A preferred embodiment of the invention shown in the drawings pertains to a large cylindrical hyperbolic cooling tower that measures over 500 feet in height and about 400 feet in diameter at its base. The structure includes an outer shell, generally 10, constructed essentially of steel reinforced concrete which is supported on angled columns 12 that, between columns, provide a largely open peripheral area of about twenty five to thirty feet in height above ground surface. A large cooled water pool 14 approximately eight feet deep is located beneath the interior of the shell, generally 10 and columns 12.

Figure 2:
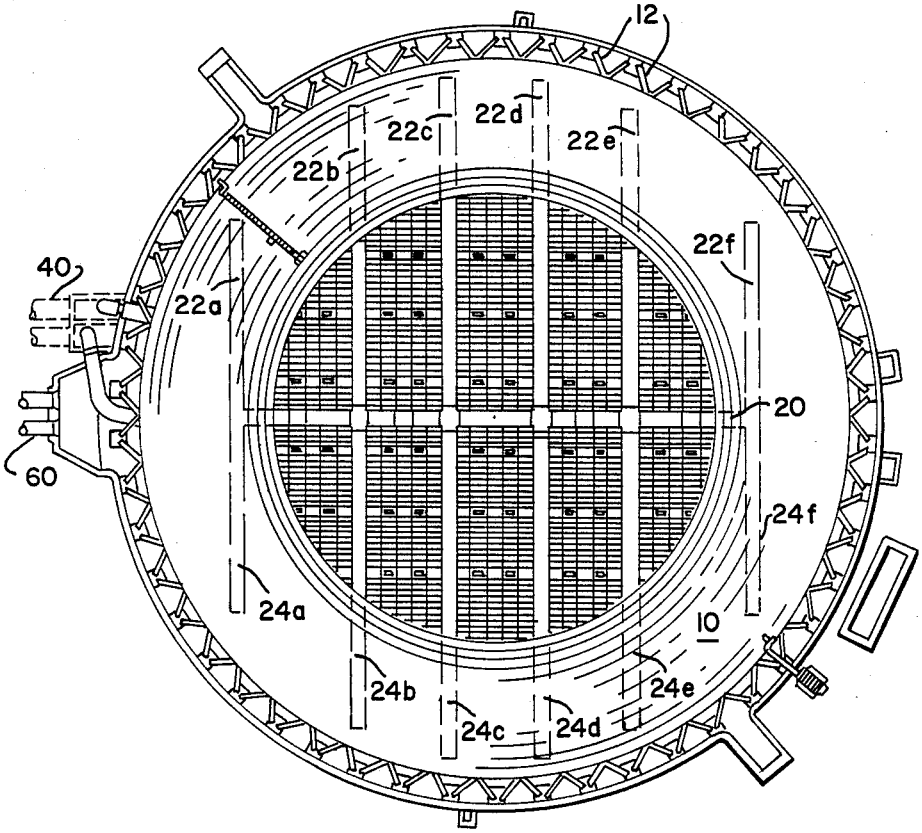
FIG. 2 is a plan view of the cooling tower of FIG. 1.
Figure 3:
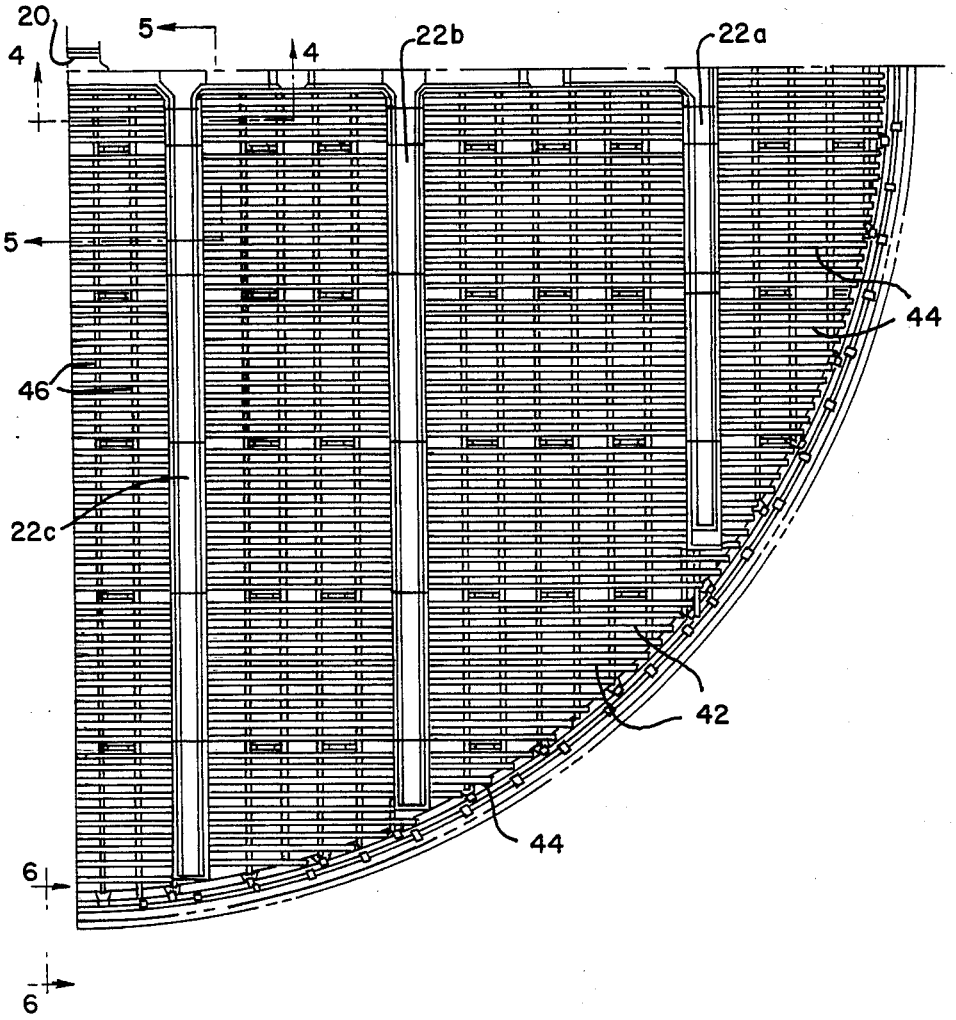
FIG. 3 is a detail plan view of one quandrant of a cooling tower similar to FIG. 1 taken at 3—3 in FIG. 1 from above the level of the water distribution system and fill.
Figure 4:
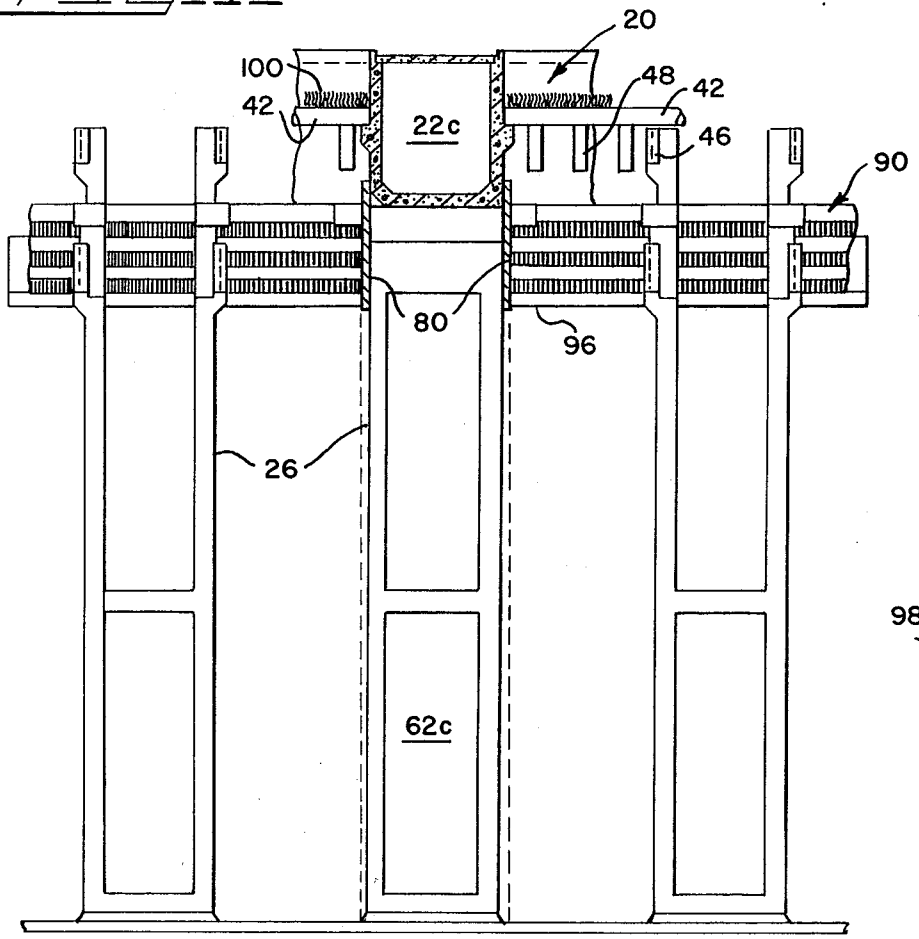
FIG. 4 is a partial detailed elevation view, partially in section showing the present invention taken at line 4—4 in FIG. 3.
Figure 5:
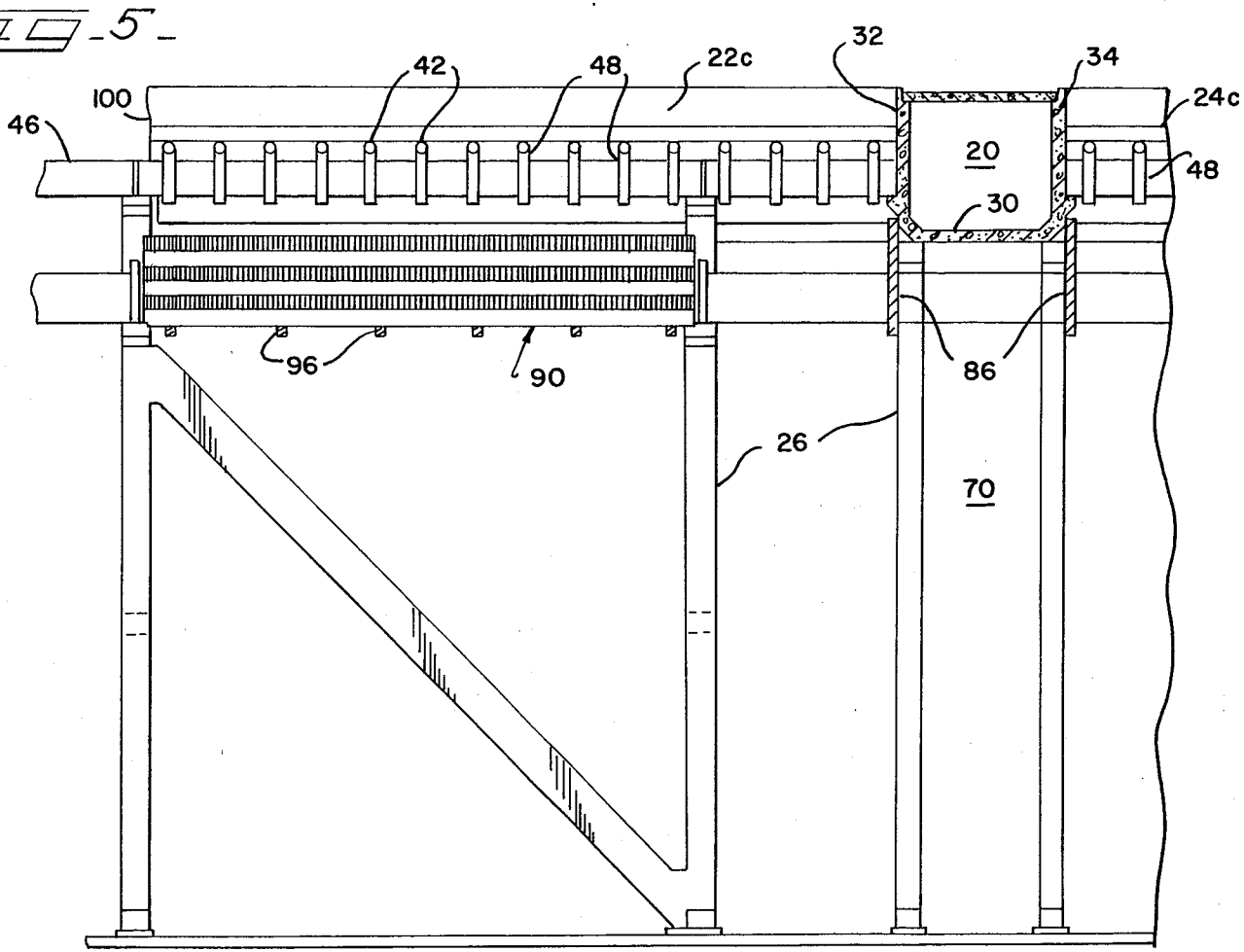
FIG. 5 is a partial detailed elevation view, partially in section showing the present invention taken at line 5—5 in FIG. 3

Within the shell generally 10 at a level approximately forty feet above the bottom of the pool 14 is a system of at least one diametrical flume 20 and a plurality of lateral flumes 22*a–f*, extending from one side, and corresponding lateral flumes 24*a–f*, extending from the other side of the diametrical flume 20 (best seen in FIGS. 2 and 3). In FIGS. 4 and 5 each flume 20, 22 and 24 is supported upon a series of spaced reinforced concrete pedestals 26 that have or leave vertical openings directly beneath the flume; and each flume comprises a bottom wall 30 and sidewalls 32, 34. The diametrical flume 20 is the major conduit for feeding water to the lateral flumes 22, 24 and therefore is normally of greater width and height as compared to the lateral flumes which may be about six by nine feet. Such a system of flumes may cover about 10% of the horizontal plan area within the shell 10. The diametrical flume is connected by large inlet header pipes 40 at one side of the shell 10 (seen only in FIG. 2) to large pumps and a source of heated water such as the condensers of a nuclear power plant steam turbine (not shown) or other industrial waste heat source.

The lateral flumes 22, 24 are interconnected by a large number of supply pipes 42 which extend between each pair of adjacent lateral flumes, e.g. flumes 22*a* and 22*b*, and additional supply pipes 44 extend outwardly from the outermost lateral flumes 22*a*, 22*f*, 24*a* and 24*f* and from the portions of the ends of all other flumes that are beyond the reach of an adjacent flume (as shown in FIGS. 3, 4 and 5). A large plurality of precast concrete beams 46, running parallel to the lateral flumes 22, 24 support the pipes 42, 44. All of the supply pipes 42, 44 have a plurality of downwardly extending equally spaced nozzles 48 designed to spray water, delivered through the flumes, over substantially the entire area within the lower interior portion of shell, generally 10, and onto heat exchanging fill surfaces. Air within the shell 10 becomes heated and expanded thereby and rises due to natural buoyancy or "chimney effect" through the hyperbolic constriction which causes the air to speed up and induce a draft of fresh air into the shell, generally 10, from the outside perimeter and between the angled support columns 12. The supply pipes 42 are plugged at locations between interconnected flumes so as to balance the delivery of water to the nozzles 48 from the respective flumes.

The descending water from spray nozzles 48 is cooled by the air and falls into the pool 14 from whence it is extracted and returned to in-plant condensers through return headers 60 (seen in FIG. 2). It will be understood that the volumes of water being sprayed through an apparatus of this type will result in a dense shower of water droplets and streamlets falling across the entire lower area interior of the shell 10 exposed to air entering from between the columns 12.

Indeed in prior structures additional nozzles have extended downwardly directly from the flume bottom walls 30 and fill materials were placed beneath the flumes 20, 22, 24 to maximize, to the greatest degree possible, the water surface available for contact by the moving air. As a result horizontal air movement is greatly impeded by the descending water and the air has tended to move vertically through paths of least resistance in the areas closer to the inside of shell 10. The foregoing structure and function has been typical of large prior art cooling towers and does not, per se, constitute the present invention which resides in the following modifications and additions.

According to the present invention air flow means comprising passageways are provided from about the perimeter of shell 10 to the central portions within the shell for ambient air to move horizontally and inwardly from outside the shell. Such passageways are sheltered from descending water and thereby provide pathways where airflow is unimpeded. Preferably the passageway includes confining means 80 and 86 (FIGS. 4 and 5), at least in part, to retain at least part of the air moving therein from upward escape before reaching the central portions of the cooling tower. That is the air flow means enables quantities of fresh cool air to by-pass the peripheral areas of fill and move directly to interior areas of fill. The passageways and confinements also function to physically segregate and isolate areas of fill so as to impede transmission and spread of combustion should it occur within the fill.

In the illustrated embodiment the air flow means are located beneath the flumes 20, 22 and 24 and comprise lateral passageways 62*a–f* and 64*a–f*, under each of the respective lateral flumes 22*a–f* and 24*a–f* (only lateral passageway 62*c* is shown in FIG. 4) and a central cross passageway 70 beneath the diametrical flume 20 (shown in FIG. 5). The lateral passageways 62*a–f* and 64*a–f* are comprised of the lateral flume bottom walls 30 and curtain walls 80 hung beneath opposite edges of the lateral flumes (directly beneath the flume sidewalls 32–34). Similarly the central cross passageway 70 is comprised of the diametrical flume bottom wall 30 and curtain walls 86 hung beneath opposite edges of the diametrical flume 20.

The curtain walls 80, 86 are made of a fire resistant or fire proof material, preferably stainless steel plates and, in the embodiment illustrated are a plurality of panels fastened by anchor bolts to the respective flumes. The curtain walls may also be supported by the flume pedestals 26 and other superstructure found within the cooling tower. Further the curtain walls 80, 86 are of a vertical dimension to extend at least fully across the height of the fill banks, hereinafter described more fully;

and the curtain 80 under the lateral flumes 22*a–f* and 24*a–f* are extended horizontally to the interior surface of the hyperbolic tower shell, generally 10. Additional peripheral curtain walls 82 are positioned between adjacent lateral flumes and close to the inner surface of shell 10 as seen in FIG. 6.

In some installations it will be advantageous to vertically extend the curtain walls 80, beneath at least the outer portions of the lateral flumes, the full distance beneath the flumes and essentially to about the level of water in pool 14. (Such structure being illustratively represented by phantom lines in FIG. 4.) This configuration will confine and assure air flow to the centermost areas of fill and prevent premature upward spillage into the peripheral areas of fill.

Fill banks are comprised of sheets generally 90 closely packed into all of the areas between flumes and the interior of shell 10. These fill sheets, usually of a polyvinyl chloride material, are vertically positioned with the uppermost edges at about the level of the flume bottom walls 30 and about two feet beneath the discharge ends of nozzles 48. The fill sheets extend downwardly in the illustrated embodiment about six feet where they rest upon and are supported by a plurality of spaced lintels 96 that span a network of beams between and below the lateral flumes 22, 24.

Figure 6:
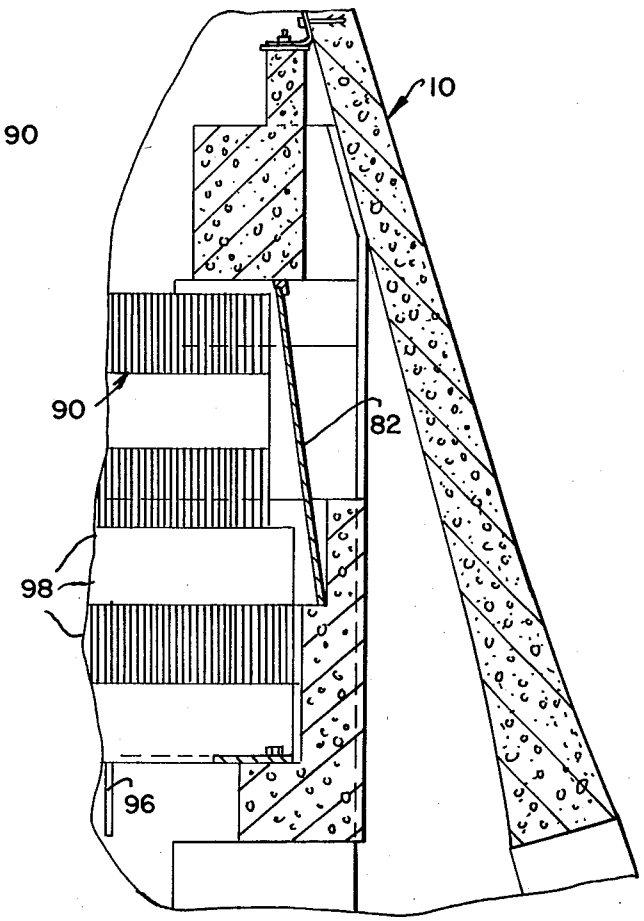
FIG. 6 is a partial detailed elevation view taken at line 6—6 in FIG. 3.

A preferred form of fill sheets 90, shown in FIG. 6 of the illustrated embodiment, are one foot in height with each sheet spaced about ¾ inch from an adjacent sheet and a series of six layers 98 of fill sheets are cross laid at right angles in alternate layers upon one another. This provides both structural rigidity and maximum exposure of water, cascading across the surfaces of the fill sheets, to the air which moves upwardly through out the fill sheets.

It will be understood that the above described structure including lateral passageways 62, 64 and central cross passageway 70 will enable air to flow inward from the periphery of shell 10, unobstructed by either fill sheets 90 or falling water, through the full vertical area beneath the lateral flumes 22, 24. As the air moves to the interior of the cooling tower it will incrementally spill outward and upward of the curtain walls 80 into adjacent areas of fill sheets 90. Large quantities of the horizontally flowing ambient air will actually reach the central cross passageway 70 where it will move across the very center of the cooling tower and spill outward and upward of the curtain walls 86 and through the centrally located fill sheets which, without the air passageways, would be virtually starved for a cool air supply.

The air moving upwardly through the aforedescribed fill sheets 90 will entrain a quantity of small discrete droplets which are extracted from the air by mist eliminators 100 which comprise a large plurality of closely positioned baffles supported upon and spanning the supply pipes 42, 44. These baffles collect water droplets and cause them to coalesce into larger droplets which will fall downward onto the fill.

It is to be understood that the foregoing invention is not restricted to natural draft or large hyperbolic cooling towers. Air draft may be supplied or assisted by mechanical draft where the air is impelled by motor driven fans. Indeed it may be possible to further improve the above described embodiment by mechanically forcing or drawing air into the lateral passageways 62*a–f* and 64*a–f*. Also air flow passageways will be beneficial to cooling towers of any size where it is found that there are interior areas that otherwise receive a significantly lesser quantity of fresh cool air per unit of fill than passes through the peripheral area of fill.

The foregoing detailed description has been given for clearness of understanding and to provide a complete description of a preferred embodiment of the invention. Various modifications may be made without departing from the spirit and scope of the invention which is defined in the following claims.

What is claimed is:

1. An improved cooling tower structure having a plurality of fill sheets within a perimeter of the cooling tower, water sprays delivering water to said fill sheets and an exposed area for air to enter between the fill sheets, said improvement comprising:

a plurality of horizontally separated sheltered passageways with confining means extending from said cooling tower perimeter between areas of descending water from said sprays positioned to deliver ambient air from outside said cooling tower to internally located portions of said exposed area of said fill sheets.

2. The structure of claim 1 wherein said confining means include walls that are at least coextensive with a dimension of said fill sheets and which segregate said fill sheets into separate banks extending between said passageways.

3. An improved counterflow cooling tower structure having a plurality of vertical fill sheets within a surrounding perimeter shell of the cooling tower, water sprays above the fill sheets for delivering water thereto and an open area of the perimeter shell beneath the fill sheets for ambient air to enter the cooling tower, said improvement comprising;

a plurality of horizontally separated sheltered passageways with confining means extending from said shell between areas of descending water from said sprays positioned adjacent said fill sheets to deliver ambient air from outside said perimeter shell to internal locations centrally within said perimeter beneath said fill sheets.

4. The structure of claim 3 wherein said confining means include walls that are at least coextensive with the vertical dimension of said fill sheets and which segregate said fill sheets into separate banks extending between said passageways.

5. The structure of claim 4 wherein said passageways include at least some walls that extend vertically a distance equal to the height of the open area beneath said fill sheets.

6. The structure of claim 3 wherein said confining means include areas beneath conduits for delivering water to said water sprays, said conduits forming upper walls for said passageways and having curtain walls beneath opposite sides of said conduits forming partial sides for said passageways which segregate said fill sheets in banks between said conduits and direct ambient air horizontally toward the internal locations where the air will spill outward of said curtain walls to the underedge of said fill sheets.

7. The structure of claim 6 wherein said curtain walls are comprised of a non-combustible material and thereby will prevent the spread of combustion between said banks of fill sheets.

8. An improved large counterflow cooling tower structure having a plurality of vertical fill sheets at a horizontal level within a surrounding cooling tower shell, a network of flumes above said fill sheets for delivering water to spray nozzles above the fill sheets and an open area at the perimeter of the shell below said fill sheets for ambient air to enter the cooling tower, said improvement comprising:

curtain walls coextensive with said flumes and extending beneath the edges thereof to a level below about the bottom of said fill sheets, said curtain walls extending from the ends of at least some of said flumes to said shell whereby to form, with the bottom of said flumes, passageways extending inwardly from said shell to areas central of the shell perimeter; said fill sheets arranged in banks segregated from one another by said curtain walls; and said spray nozzles confined to locations directly above said fill sheets within segregated banks whereby no water is sprayed or falls into said passageways and the areas beneath said flumes, and air moving inwardly beneath said flumes is not contacted by descending water.

9. The structure of claim 8 including at least one flume oriented centrally of said shell and a plurality of flumes extending outward of said one flume to about the perimeter of said shell.

10. The structure of claim 8 wherein said curtain walls are constructed of non-combustible material so as to prevent spread of combustion between banks of fill sheets.

11. The structure of claim 8 wherein said banks of vertical fill sheets are comprised of multiple horizontal layers of fill sheets with the fill sheets in alternate layers thereof arranged at an angle to fill sheets in each adjacent layer.

* * * * *